US011022336B2

(12) United States Patent
Zhong et al.

(10) Patent No.: US 11,022,336 B2
(45) Date of Patent: Jun. 1, 2021

(54) SWITCHING DEVICE FOR MULTI-SPLIT AIR CONDITIONER AND MULTI-SPLIT AIR CONDITIONER HAVING SAME

(71) Applicants: GD MIDEA HEATING & VENTILATING EQUIPMENT CO., LTD., Foshan (CN); MIDEA GROUP CO., LTD., Foshan (CN)

(72) Inventors: Rujiang Zhong, Foshan (CN); Zhixian Jiang, Foshan (CN)

( * ) Notice: Subject to any disclaimer, the term of this patent is extended or adjusted under 35 U.S.C. 154(b) by 110 days.

(21) Appl. No.: 16/282,313

(22) Filed: Feb. 22, 2019

(65) Prior Publication Data

US 2019/0186773 A1 Jun. 20, 2019

Related U.S. Application Data

(63) Continuation of application No. PCT/CN2017/089353, filed on Jun. 21, 2017.

(30) Foreign Application Priority Data

Aug. 23, 2016 (CN) ..... 201620924213.8

(51) Int. Cl.
*F24F 11/72* (2018.01)
*F24F 13/20* (2006.01)
(Continued)

(52) U.S. Cl.
CPC ..... *F24F 11/72* (2018.01); *F24F 11/84* (2018.01); *F24F 13/20* (2013.01); *F24F 13/24* (2013.01);
(Continued)

(58) Field of Classification Search
CPC ..... F25B 29/00; F25B 41/003; F25B 43/00; F25B 2313/023; F25B 2400/23; F24F 11/72; F24F 11/84
See application file for complete search history.

(56) References Cited

U.S. PATENT DOCUMENTS 9,410,731 B1 8/2016 Rowland
2015/0034293 A1* 2/2015 Takayama ..... F25B 25/005 165/207
(Continued)

FOREIGN PATENT DOCUMENTS

CN 2797956 Y 7/2006
CN 102575881 A 7/2012
(Continued)

OTHER PUBLICATIONS

International Search Report dated Aug. 16, 2017 in the corresponding International Application No. PCT/CN/2017/084972.
(Continued)

*Primary Examiner* — Marc E Norman
(74) *Attorney, Agent, or Firm* — Kilpatrick Townsend & Stockton, LLP

(57) ABSTRACT

A switching device for a multi-split air conditioner, comprising: a housing, a gas-liquid separator, multiple first indoor unit interface pipes, at least one heat exchange component, and multiple second indoor unit interface pipes. The gas-liquid separator is provided with an inlet to an outdoor unit, a first outlet, and a second outlet. The multiple first indoor unit interface pipes and the multiple second indoor unit interface pipes are spaced from each other in a first direction. The first outlet is connected to multiple first interfaces by means of the multiple first indoor unit interface pipes, respectively. The first and second indoor unit interface pipes are spaced apart in a second direction. Some of the first and second indoor unit interface pipes are spaced apart from the rest of the first indoor unit interface pipes and the rest of the second indoor unit interface pipes in the second direction.

20 Claims, 3 Drawing Sheets

(51) Int. Cl.

| | |
|---|---|
| ***F24F 13/24*** | (2006.01) |
| ***F25B 43/00*** | (2006.01) |
| ***F25B 41/40*** | (2021.01) |
| ***F24F 11/84*** | (2018.01) |
| ***F25B 29/00*** | (2006.01) |

(52) U.S. Cl.
CPC ..... *F25B 29/00* (2013.01); *F25B 41/40* (2021.01); *F25B 43/00* (2013.01); *F24F 2013/242* (2013.01); *F25B 2313/023* (2013.01); *F25B 2400/23* (2013.01); *F25B 2600/2519* (2013.01)

(56) References Cited

U.S. PATENT DOCUMENTS

| | | | | |
|---|---|---|---|---|
| 2017/0089623 | A1* | 3/2017 | Kamitani | F16K 51/00 |
| 2017/0167761 | A1* | 6/2017 | Ikeda | F25B 41/04 |
| 2018/0266705 | A1* | 9/2018 | Martinez Galvan | F24F 13/06 |
| 2018/0340700 | A1* | 11/2018 | Chen | F25B 13/00 |
| 2019/0186772 | A1* | 6/2019 | Zhong | F24F 1/34 |

FOREIGN PATENT DOCUMENTS

| | | | |
|---|---|---|---|
| CN | 103375904 | A | 10/2013 |
| CN | 104154673 | A | 11/2014 |
| CN | 104350340 | A | 2/2015 |
| CN | 104776630 | A | 7/2015 |
| CN | 204438440 | U | 7/2015 |
| CN | 204612118 | U | 9/2015 |
| CN | 105674532 | A | 6/2016 |
| CN | 106196345 | A | 12/2016 |
| CN | 205957354 | U | 2/2017 |
| CN | 206001759 | U | 3/2017 |
| EP | 2204626 | A1 | 7/2010 |
| EP | 2860471 | A1 | 4/2015 |
| JP | 2014129948 | A | 7/2014 |
| WO | 2015087756 | A1 | 6/2015 |

OTHER PUBLICATIONS

International Search Report dated Sep. 30, 2017 in the corresponding International Application No. PCT/CN/2017/089353.
The Office Action dated Jul. 9, 2019 in the corresponding EP application No. 17842676.3.
CA Office Action No. 3,034,567.

* cited by examiner

SWITCHING DEVICE FOR MULTI-SPLIT AIR CONDITIONER AND MULTI-SPLIT AIR CONDITIONER HAVING SAME

RELATED APPLICATIONS

This application is a continuation of International Application No. PCT/CN2017/089353, filed on Jun. 21, 2017, which claims priority to Chinese Patent Application No. 201620924213.8, filed with the Chinese Patent Office on Aug. 23, 2016, and entitled "SWITCHING DEVICE FOR MULTI-SPLIT AIR CONDITIONER AND MULTI-SPLIT AIR CONDITIONER HAVING SAME", which is incorporated herein by reference in their entirety.

FIELD

The present disclosure relates to the field of air conditioners, more particularly to a switching device for a multi-split air conditioner and a multi-split air conditioner having the same.

BACKGROUND

In the related art, although the switching device of the air conditioner can realize the separate cooling and heating of different indoor units through the valve body and the related control, due to the limitation of system setting and structural space, the number of indoor units that can be connected is relatively limited, generally less than six ports, i.e., the capacity is not large enough. If the size of the cabinet of the switching device is increased proportionally on the existing basis, the entire device will be too large, thus affecting the application occasion and the installation position. In addition, many of the existing small-sized switching devices are foamed inside the cabinet, thus making the entire refrigeration part unable to be repaired.

SUMMARY

Embodiments of the present disclosure are to provide a switching device for a multi-split air conditioner, which tends not to affect the application occasion and the installation position thereof.

Another embodiment of the present disclosure is to provide a multi-split air conditioner having the above switching device.

One embodiment of the present disclosure provides the switching device for the multi-split air conditioner. The multi-split air conditioner includes an outdoor unit, and a plurality of indoor units having a plurality of first ports and a plurality of second ports. The switching device includes: a housing; a gas-liquid separator disposed in the housing, and having an inlet, a first outlet and a second outlet, the inlet being configured to be connected to the outdoor unit; a plurality of first indoor-unit connection tubes spaced apart in a first direction, the first outlet being connected to the plurality of first ports via the plurality of first indoor-unit connection tubes, respectively; at least one heat exchange part having an end connected to the second outlet; and a plurality of second indoor-unit connection tubes spaced apart from the plurality of first indoor-unit connection tubes in a second direction perpendicular to the first direction, the plurality of second indoor-unit connection tubes being spaced apart in the first direction. The heat exchange part has another end connected to the plurality of second ports via the plurality of second indoor-unit connection tubes respectively, part of the plurality of first indoor-unit connection tubes and the plurality of second indoor-unit connection tubes are spaced apart from the rest of the plurality of first indoor-unit connection tubes and the plurality of the second indoor-unit connection tubes in the second direction.

In the switching device for the multi-split air conditioner according to the present disclosure, by arranging the first indoor-unit connection tubes and the second indoor-unit connection tubes configured to be connected to the indoor units in a plurality of layers, a length of the switching device in the first direction is reduced, so as not to affect the application occasion and the installation position of the switching device. Moreover, by providing the gas-liquid separator to perform the gas-liquid separation on the refrigerant, the state of the refrigerant can be improved, and the noise of the multi-split air conditioner can be reduced, thus further facilitating the heating or cooling of the multi-split air conditioner.

According to some embodiments of the present disclosure, the switching device for the multi-split air conditioner further includes: a solenoid valve assembly including a plurality of solenoid valve units arranged side by side, a first U-shaped tube and a second U-shaped tube, each solenoid valve unit including a first one-way solenoid valve and a second one-way solenoid valve, the first U-shaped tube being connected to the first outlet and further connected to the plurality of first indoor-unit connection tubes respectively via the plurality of first one-way solenoid valves, the plurality of first indoor-unit connection tubes being configured to be connected to the outdoor unit respectively via the plurality of second one-way solenoid valves, the first one-way solenoid valve being configured to unidirectionally guide a refrigerant in the first U-shaped tube into the corresponding first indoor-unit connection tube, the second one-way solenoid valve being configured to unidirectionally guide the refrigerant in the first indoor-unit connection tube into the outdoor unit, and one of the first U-shaped tube and the second U-shaped tube being disposed at an inner side of the other one of the first U-shaped tube and the second U-shaped tube.

In one embodiment, the heat exchange part is disposed at the inner sides of the first U-shaped tube and the second U-shaped tube.

Moreover, the switching device for the multi-split air conditioner further includes: a check valve assembly disposed below the solenoid valve assembly, the check valve assembly including a plurality of check valve units arranged side by side and extending in a horizontal direction, each check valve unit including a first check valve and a second check valve configured to be arranged in parallel between the heat exchange part and the second indoor-unit connection tube, the first check valve being configured to unidirectionally guide the refrigerant in the heat exchange part to the indoor unit, and the second check valve being configured to unidirectionally guide the refrigerant in the indoor unit to the heat exchange part.

In one embodiment, the first check valve and the second check valve are arranged one above the other.

Specifically, the housing has a substantially cuboid shape, the first direction is a length direction of the housing; the heat exchange part, the solenoid valve assembly and the check valve assembly are all disposed in the housing, the solenoid valve assembly is arranged above the check valve assembly, the solenoid valve assembly and the check valve assembly are disposed at one side in the length direction of the housing, while the gas-liquid separator and the heat exchange part are disposed at the other side in the length direction of the housing, and the gas-liquid separator and the heat exchange part are arranged sequentially in a width direction of the housing; an electric control box assembly is disposed outside the housing, the electric control box assembly is arranged vertically and disposed to a side surface of the housing.

According to some embodiments of the present disclosure, the plurality of first indoor-unit connection tubes are arranged in a plurality of layer spaced apart in the second direction, the plurality of second indoor-unit connection tubes are arranged in a plurality of layers spaced apart in the second direction, and the plurality of layers of first indoor-unit connection tubes are spaced apart from the plurality of layers of second indoor-unit connection tubes in the second direction.

In one embodiment, two adjacent layers of first indoor-unit connection tubes are staggered in the first direction, and two adjacent layers of second indoor-unit connection tubes are staggered in the first direction.

Further In one embodiment, the first indoor-unit connection tube is in one to one correspondence with the corresponding second indoor-unit connection tube in the second direction.

According to some embodiments of the present disclosure, the gas-liquid separator is configured to be arranged adjacent to the outdoor unit.

According to some embodiments of the present disclosure, the housing is provided with a soundproof cotton at an inner side thereof.

According to some embodiments of the present disclosure, the housing includes a base, and the base is provided with a drain tank.

According to some embodiments of the present disclosure, the housing includes a base having an open top, and a top cover detachably disposed to the top of the base.

A multi-split air conditioner according to one embodiment of the present disclosure includes the switching device for the multi-split air conditioner according to the above embodiments of the present disclosure.

BRIEF DESCRIPTION OF THE DRAWINGS

The above and/or additional embodiments of the present disclosure will become apparent and more readily appreciated from descriptions of embodiments made with reference to the following drawings, in which.

REFERENCE NUMERALS

Figure 1:
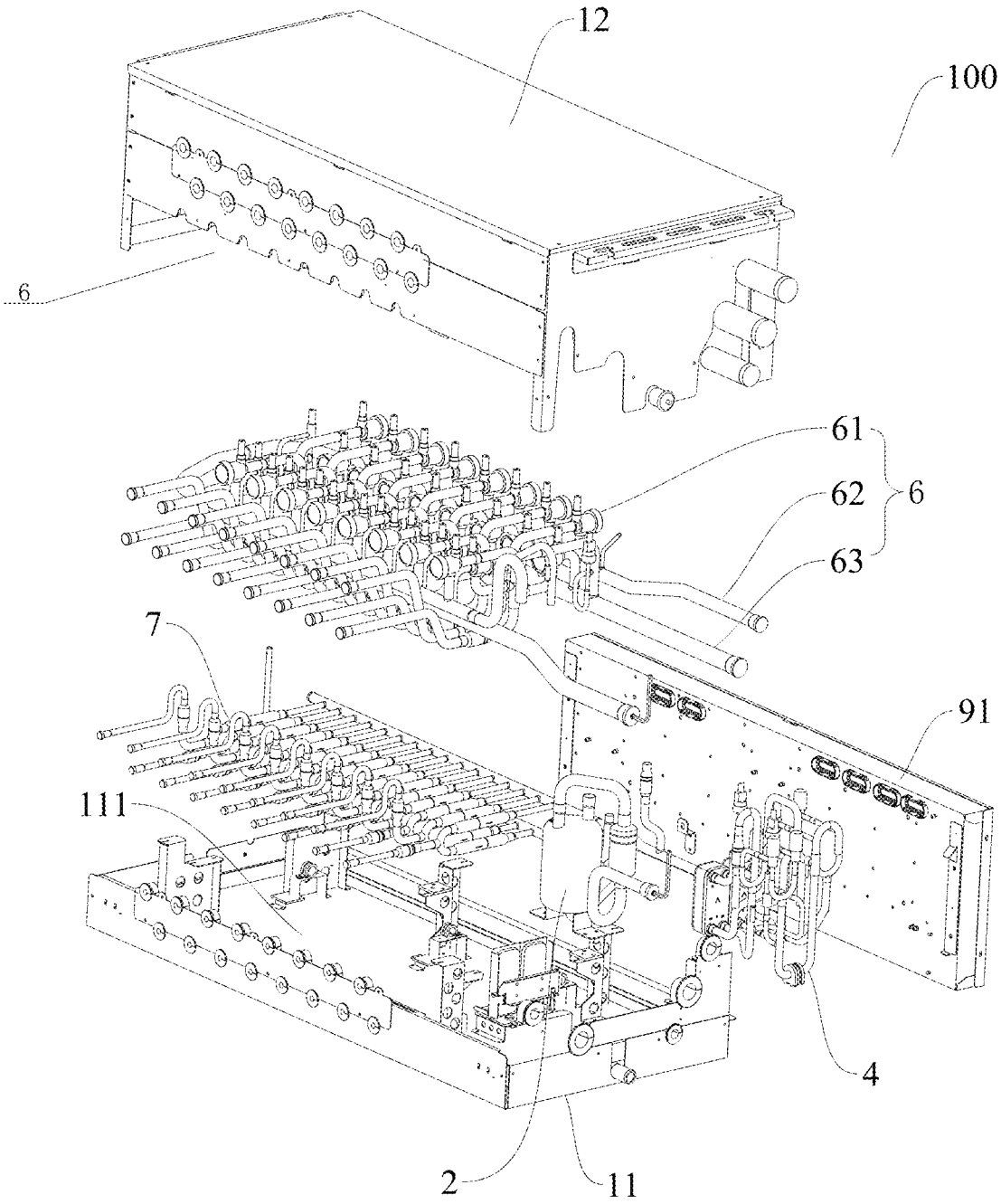
FIG. 1 is an exploded view of a switching device for an air conditioner according to an embodiment of the present disclosure.

100: switching device;

1: housing; 11: base; 111: drain tank; 12: top cover;

2: gas-liquid separator; 21: inlet; 22: first outlet; 23: second outlet;

3: first indoor-unit connection tube; 4: heat exchange part;

5: second indoor-unit connection tube; 6: solenoid valve assembly;

61: solenoid valve unit; 611: first one-way solenoid valve; 612: second one-way solenoid valve;

62: first U-shaped tube; 63: second U-shaped tube;

7: check valve assembly; 71: first check valve; 72: second check valve;

8: extension section; 9: throttling device; 91: electric control box assembly.

DETAILED DESCRIPTION

Embodiments of the present disclosure will be described in detail and examples of embodiments are illustrated in the drawings. The same or similar elements and the elements having the same or similar functions are denoted by like reference numerals throughout the descriptions. Embodiments described herein with reference to drawings are explanatory, serve to explain the present disclosure, and are not construed to limit embodiments of the present disclosure.

In the description of the specification, it should be understood that the orientation or positional relationship indicated by the terms such as "central", "longitudinal", "transverse", "length", "width", "thickness", "upper", "lower", "front", "rear", "left", "right", "vertical", "horizontal", "top", "bottom", "inner", "outer", "axial", "radial" and "circumferential" and the like is based on the orientation or positional relationship shown in the drawings, only for convenience of description of the present disclosure and simplification, and is not intended to indicate or imply that the device or component referred to has a particular orientation, is constructed and operated in a particular orientation, and thus is not to be understood as limiting the present disclosure.

In the description of the present disclosure, unless specified or limited otherwise, the terms "mounted", "connected", "coupled" and the like are used broadly, and may be, for example, fixed connections, detachable connections, or integral connections; may also be mechanical or electrical connections; may also be direct connections or indirect connections via intervening structures; may also be inner communications of two elements.

A switching device 100 for a multi-split air conditioner (not shown) according to an embodiment of the present disclosure will be described with reference to FIGS. 1-4. The multi-split air conditioner includes an outdoor unit and a plurality of indoor units having a plurality of first ports and a plurality of second ports. The outdoor unit is connected to the plurality of indoor units through the switching device 100, and the plurality of indoor units may be respectively disposed in a plurality of rooms, such that separate cooling or heating in different rooms can be realized by the switching device 100. In the description of the present disclosure, "a plurality" means two or more, unless specified otherwise.

Figure 4:
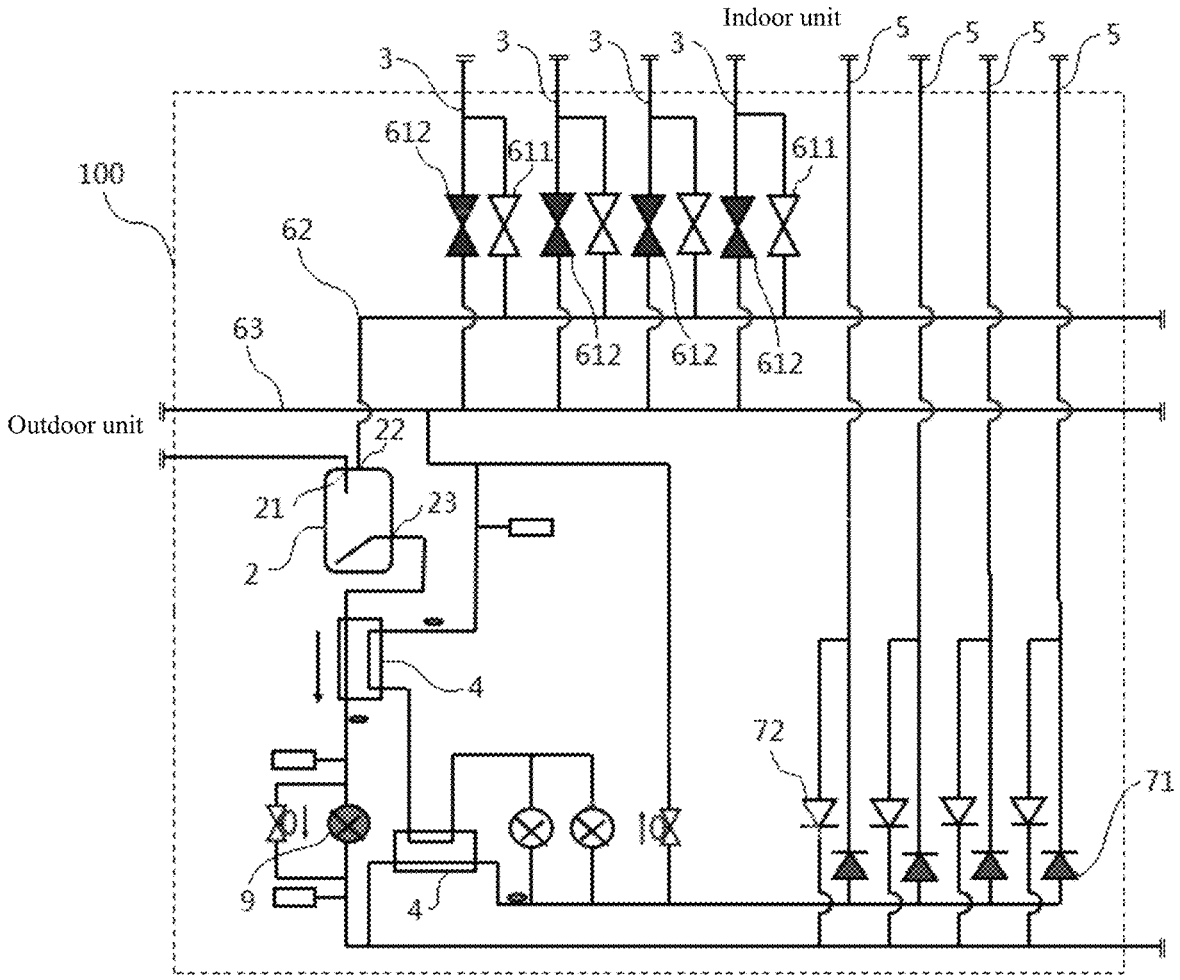
FIG. 4 is a schematic view of a switching device for an air conditioner according to an embodiment of the present disclosure.

As shown in FIG. 1 and FIG. 4, the switching device 100 for the air conditioner according to embodiments of the present disclosure includes a housing 1, a gas-liquid separator 2, a plurality of first indoor-unit connection tubes 3, at least one heat exchange part 4, and a plurality of second indoor-unit connection tubes 5.

The housing 1 functions to close and protect the various parts disposed therein. The gas-liquid separator 2 is disposed in the housing 1, and the gas-liquid separator 2 may be used for a gas-liquid separation of a gas-liquid two-phase refrigerant entering from the outdoor unit, so as to improve the heating and cooling effects. The gas-liquid separator 2 has an inlet 21, a first outlet 22 and a second outlet 230. The inlet 21 is configured to be connected to the outdoor unit, such that the refrigerant entering through the inlet 21 is discharged out of the first outlet 22 and the second outlet 23 respectively after being subjected to the gas-liquid separation in the gas-liquid separator 20. In the following description of the present disclosure, an example, in which the separated gaseous refrigerant is discharged out of the first outlet 22 and the separated liquid refrigerant is discharged out of the second outlet 23, will be described for illustration. In this case, the first outlet 22 may be disposed to the top of the gas-liquid separator 2, and the second outlet 23 may be disposed to a lower portion of the gas-liquid separator 20. The inlet 21 may be in the form of a section of inlet pipe, and an end of the inlet pipe 21 may extend into the gas-liquid separator, so as to provide a better gas-liquid separation effect.

An end of the heat exchange part 4 is connected to the second outlet 23 of the gas-liquid separator 2. Therefore, by arranging the heat exchange part 4 downstream of the liquid refrigerant outlet of the gas-liquid separator 2, the separated liquid refrigerant enters the heat exchange part 4, and is subjected to the heat exchange and supercooling of the heat exchange part 4, such that it is possible to effectively ensure that the refrigerant flowing through the heat exchange part 4 is completely liquid.

The plurality of first indoor-unit connection tubes 3 are spaced apart from one another in a first direction (e.g. a length direction in FIG. 1), and the first outlet 22 is connected to the plurality of first ports respectively via the plurality of first indoor-unit connection tubes 3. The plurality of second indoor-unit connection tubes 5 are spaced apart from one another in the first direction, and another end of the heat exchange part 4 is connected to the plurality of second ports respectively via the plurality of second indoor-unit connection tubes 5. Therefore, by providing the first indoor-unit connection tube 3 and the second indoor-unit connection tube 5, the circulation flow of the refrigerant among the indoor unit, the first indoor-unit connection tube 3 and the second indoor-unit connection tube 5 can be realized after the indoor unit is assembled in place with the first indoor-unit connection tube 3 and the second indoor-unit connection tube 5 of the switching device 100 through the first port and the second port, and the connection between the switching device 100 and the indoor unit is facilitated. The plurality of first indoor-unit connection tubes 3 and the plurality of second indoor-unit connection tubes 5 may be arranged at even intervals in the first direction.

The plurality of second indoor-unit connection tubes 5 are spaced apart from the plurality of first indoor-unit connection tubes 3 in a second direction perpendicular to the first direction. In one embodiment, the first indoor-unit connection tube 3 and the corresponding second indoor-unit connection tube 5 (i.e., the second indoor-unit connection tube 5 connected to the same indoor unit to which the first indoor unit 3 is connected) have a one-to-one correspondence in the second direction (e.g., the first indoor-unit connection tube 3 and the second indoor-unit connection tube 5 are aligned in an up and down direction, in the example of FIG. 1). Thereby, the first indoor-unit connection tube 3 and the second indoor-unit connection tube 5 connected to the indoor unit are arranged in two layers, which relatively reduces a size of the switching device 100 in the first direction.

Part of the plurality of first indoor-unit connection tubes 3 and the plurality of second indoor-unit connection tubes 5 (which may be one or more) are spaced apart from the rest of the first indoor-unit connection tubes and the second indoor-unit connection tubes in the second direction. Thereby, the first indoor-unit connection tubes 3 and the second indoor-unit connection tubes 5 connected to the indoor units are respectively arranged in plurality of layers, which can further reduce the size of the switching device 100 in the first direction, thereby making the structure of entire switching device 100 simple and compact, and thus expanding the installation position and application occasion of the switching device 100. The indoor unit may have one first port and one second port respectively, the plurality of first indoor-unit connection tubes 3 are in one-to-one correspondence to the plurality of first ports, and the plurality of second indoor-unit connection tubes 5 are in one-to-one correspondence to the plurality of second ports.

For example, as shown in FIG. 1, the first indoor-unit connection tube 3 and the second indoor-unit connection tube 5 both extend out of the side wall of the housing 1, such that the "first direction" may be the length direction of the housing 1 shown in FIG. 1 and the "second direction" may be a height direction of the housing 1 shown in FIG. 1. Thereby, the length of the entire switching device 100 in the length direction is effectively saved, and the number of the indoor units to which the switching device 100 can be connected is relatively expanded. For example, the switching device 100 according to the present disclosure can be connected to more than six indoor units (e.g., the switching device 100 can be connected to sixteen indoor units in the example of FIG. 1), thereby implementing the control of the plurality of rooms. Of course, the "first direction" may also be the length direction of the housing 1 shown in FIG. 1, while the "second direction" is a width direction of the housing 1 shown in FIG. 1. In this case, both the first indoor-unit connection tube 3 and the second indoor-unit connection tube 5 extend out of a top wall of the housing 1. In one embodiment, the "first direction" may be inclined with respect to the length direction of the housing 1 shown in FIG. 1. It can be understood that the orientations of the "first direction" and the "second direction" may be configured according to the actual assembling requirements of the first indoor-unit connection tube 3 and the second indoor-unit connection tube 5, so as to better meet the requirements of practical application occasions and installation positions.

In the switching device 100 for the multi-split air conditioner according to the embodiment of the present disclosure, by arranging the first indoor-unit connection tubes 3 and the second indoor-unit connection tubes 5 configured to be connected with the indoor units into the plurality of layers, the length of the switching device 100 in the first direction can be relatively reduced, so as not to affect the application occasions and installation positions of the switching device 100. Further, by providing the gas-liquid separator 2 to perform the gas-liquid separation on the refrigerant, the state of the refrigerant can be improved and the noise of the multi-split air conditioner can be reduced, thereby further facilitating the heating or cooling of the multi-split air conditioner.

According to some embodiments of the present disclosure, as shown in FIGS. 1-4, the switching device 100 for the multi-split air conditioner further includes a solenoid valve assembly 6, and the solenoid valve assembly 6 includes a first U-shaped tube 62, a second U-shaped tube 63, and a plurality of solenoid valve units 61 arranged side by side. Therefore, by arranging the plurality of solenoid valve units 61 side by side, the entire solenoid valve assembly 6 has a modular design such that the entire structure of the solenoid valve assembly 6 is arranged in an orderly and compact manner.

In one embodiment, each solenoid valve unit 61 includes a first one-way solenoid valve 611 and a second one-way solenoid valve 612 for controlling different flow directions of heating and cooling of the multi-split air conditioner. The first U-shaped tube 62 is connected to the first outlet 22 and further connected to the plurality of first indoor-unit connection tubes 3 respectively via the plurality of first one-way solenoid valves 611. The first one-way solenoid valve 611 is configured to unidirectionally guide the refrigerant in the first U-shaped tube 62 into the corresponding first indoor-unit connection tube 3, while the refrigerant in the first indoor-unit connection tube 3 cannot enter the first U-shaped tube 62 through the first one-way solenoid valve 611. The plurality of first indoor-unit connection tubes 3 are configured to be connected to the outdoor unit respectively via the plurality of second one-way solenoid valves 612. The second one-way solenoid valve 612 is configured to unidirectionally guide the refrigerant in the first indoor-unit connection tube 3 into the outdoor unit, while the refrigerant in the outdoor unit cannot enter the first indoor-unit connection tube 3 through the second one-way solenoid valves 612. Thereby, the gaseous refrigerant separated from the gas-liquid separator 2 enters the first one-way solenoid valve 611 through the first U-shaped tube 62, and further enters the indoor unit through the first indoor-unit connection tube 3 to realize heating, and the refrigerant after heat exchange flows back to the outdoor unit through the second indoor-unit connection tube 5. When the multi-split air conditioner operates for refrigeration, the refrigerant flows through the second indoor-unit connection tube 5 to the indoor unit, then returns to the second U-shaped tube 63 through the second one-way solenoid valve 612, and finally returns to the outdoor unit. The connection tubes (i.e. the first indoor-unit connection tubes 3 and the second indoor-unit connection tubes 5) connecting the entire solenoid valve assembly 6 with the indoor units may be arranged in a single layer or a multi-layer array according to the actual size of the switching device 100, thereby balancing the dimensional control between the length and the height of the switching device 100.

As shown in FIG. 1, one of the first U-shaped tube 62 and the second U-shaped tube 63 is disposed at an inner side of the other one of the first U-shaped tube 62 and the second U-shaped tube 63. Therefore, by arranging the first U-shaped tube 62 and the second U-shaped tube 63 inside and outside, it is convenient for the first U-shaped tube 62 and the second U-shaped tube 63 to be connected with the plurality of solenoid valve units 61, and the structure of the entire solenoid valve assembly 6 is more compact. The plurality of solenoid valve units 61 may be located inside the first U-shaped tube 62 and the second U-shaped tube 63, and disposed adjacent to curved portions of the first U-shaped tube 62 and the second U-shaped tube 63. The first one-way solenoid valves 611 and the second one-way solenoid valves 612 of the plurality of solenoid valve units 61 are respectively connected to tube walls of the first U-shaped tube 62 and the second U-shaped tube 63 through pipes.

Figure 2:
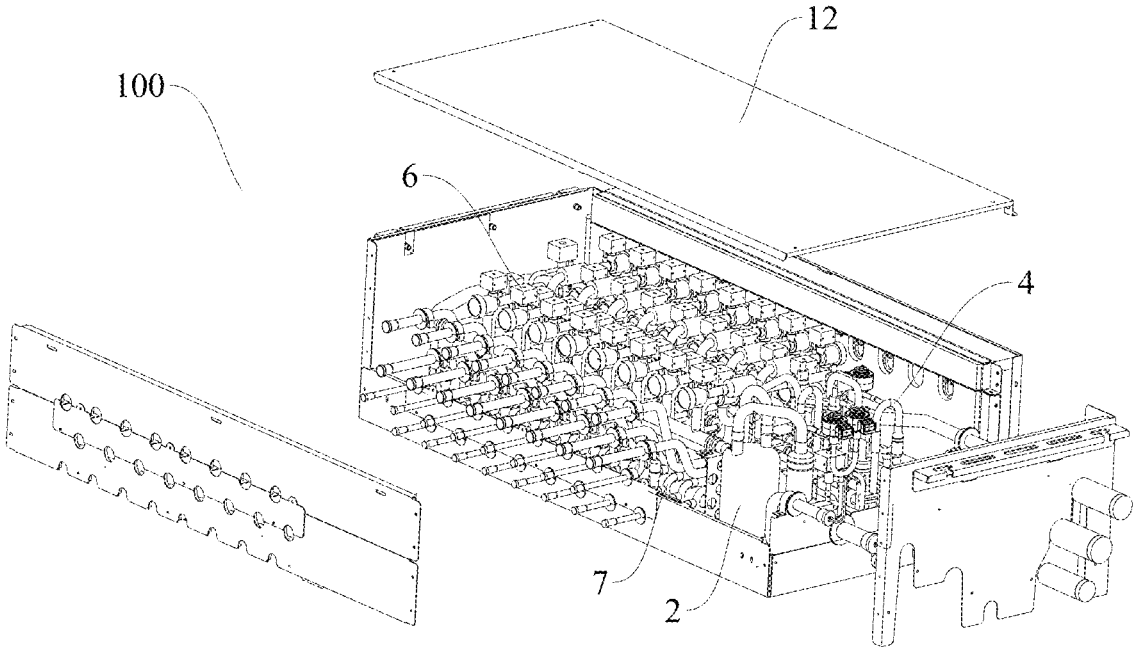
FIG. 2 is another exploded view of the switching device for the air conditioner shown in FIG. 1.
Figure 3:
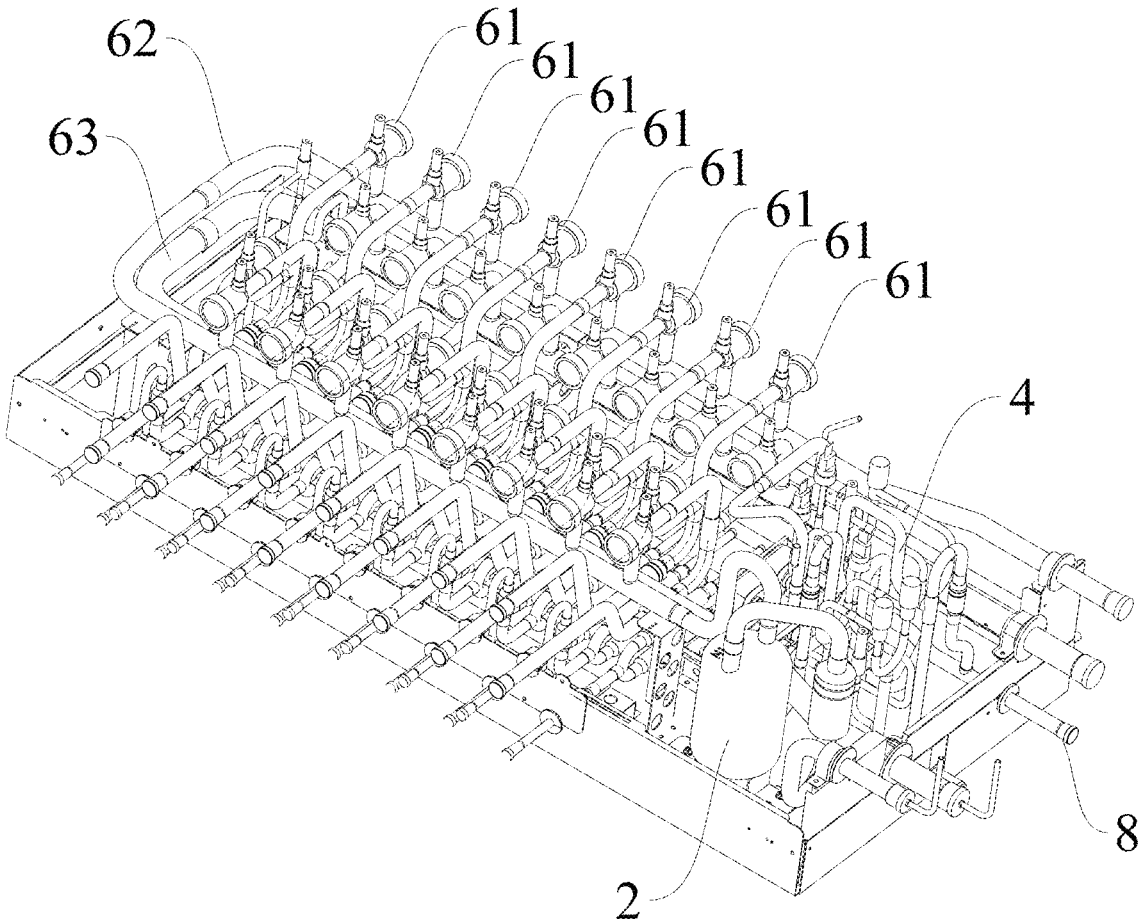
FIG. 3 is a schematic view showing the assembling of a base, a solenoid valve assembly, a check valve assembly, a gas-liquid separator and a heat exchange part shown in FIG. 2.

In one embodiment, the heat exchange part 4 is disposed inside the first U-shaped tube 62 and the second U-shaped tube 63. As shown in FIGS. 1-3, the heat exchange part 4 is located between ends of the first U-shaped tube 62 and also between ends of the second U-shaped tube 63, so as to more fully and reasonably utilize the internal space of the housing 1.

One or more heat exchange parts 4 may be provided. For example, referring to FIG. 4, two heat exchange parts 4 are sequentially disposed downstream of the gas-liquid separator 2, so as to achieve better heat exchange and supercooling. When one heat exchange part 4 is provided, the heat exchange part 4 may be provided with a heat exchange portion on both sides thereof, and the refrigerant sequentially flows through the two heat exchange portions. In this case, the function of the heat exchange part 4 is substantially the same with that of the two heat exchange parts 4 shown in FIG. 4. Further, a throttling device 9 is disposed between the two heat exchange parts 4, and the throttling device 9 may be a capillary tube or an electronic expansion valve, but is not limited thereto.

According to a further embodiment of the present disclosure, as shown in FIG. 1, the switching device 100 for the multi-split air conditioner further includes a check valve assembly 70. The check valve assembly 7 is disposed below the solenoid valve assembly 6, and the check valve assembly 7 may be disposed between the solenoid valve assembly 6 and a drain tank 111. The check valve assembly 7 includes a plurality of check valve units extending in a horizontal direction and arranged side by side. Thereby, the height of the switching device 100 in the up and down direction can be effectively reduced by flattening the check valve assembly 7.

In one embodiment, each of the check valve units includes a first check valve 71 and a second check valve 72 configured to be arranged in parallel between the heat exchange part 4 and the second indoor-unit connection tube 5 for controlling different flow directions of heating and cooling of the multi-split air conditioner. The first check valve 71 is configured to unidirectionally guide the refrigerant in the heat exchange part 4 to the indoor unit, while the refrigerant in the indoor unit cannot enter the heat exchange part 4 through the first check valve 71. The second check valve 72 is configured to unidirectionally guide the refrigerant in the indoor unit to the heat exchange part 4, while the refrigerant in the heat exchange part 4 cannot enter the indoor unit through the second check valve 72. The entire check valve assembly 7 can be connected during field installation. The connection tubes (i.e. the second indoor-unit connection tubes 5) connecting the entire check valve assembly 7 to the indoor unit may be arranged in a single layer or a multi-layer array according to the actual size of the switching device 100, thereby balancing the dimensional control between the length and height of the switching device 100.

In one embodiment, the first check valve 71 and the second check valve 72 are arranged in the up and down direction as shown in FIG. 1. Thereby, the size of the entire check valve assembly 7 in the length direction of the housing 1 can be reduced, thus making the entire structure of the switching device 100 more compact.

As shown in FIGS. 2-4, the pipe connected between the second check valve 72 and the heat exchange part 4 has an extension section 8 that extends out of the housing 1. An end of the first U-shaped tube 62 and an end of the second U-shaped tube 63 may respectively extend out of the housing 1. When the number of the indoor units to be connected is large, the above ends of the first U-shaped tubes 62, the above ends of the second U-shaped tubes 63, and the extension sections 8 of multiple switching devices 100 may be respectively connected together in one to one correspondence, thereby realizing the series connection of the multiple switching devices 100 and facilitating the expansion of the number of ports of the indoor units.

According to some embodiments of the present disclosure, as shown in FIG. 4, the gas-liquid separator 2 is configured to be disposed adjacent to the outdoor unit. In this case, the gas-liquid separator 2 is located in the housing 1 and at a side close to the outdoor unit, and the main function of the gas-liquid separator 2 is to separate the gas-liquid two-phase refrigerant entering from the outdoor unit, such that the gaseous refrigerant is discharged from the heating side, and the liquid refrigerant is discharged from the cooling side, thereby achieving better cooling and heating effects. The placement manner of the gas-liquid separator 2 is not limited to a vertical or horizontal type, as long as the gas-liquid separation function can be realized.

According to some embodiments of the present disclosure, as shown in FIGS. 1 and 2, the housing 1 has a substantially cuboid shape, and the first direction is the length direction of the housing 1 shown in FIG. 1. The gas-liquid separator 2, the heat exchange part 4, the solenoid valve assembly 6 and the check valve assembly 7 are all disposed in the housing 1, and the solenoid valve assembly 6 is arranged above the check valve assembly 70. The solenoid valve assembly 6 and the check valve assembly 7 are both disposed horizontally, and the solenoid valve assembly 6 may be arranged direct above the check valve assembly 7 so as to further improve the compactness of the entire switching device 100. The solenoid valve assembly 6 and the check valve assembly 7 are disposed at one side (e.g. a left side in FIG. 1) in the length direction of the housing 1. In this case, the solenoid valve assembly 6 and the check valve assembly 7 may be adjacent to a left side wall of the housing 1, while the gas-liquid separator 2 and the heat exchange part 4 are disposed at the other side (e.g. a right side in FIG. 1) in the length direction of the housing 1, and the gas-liquid separator 2 and the heat exchange part 4 are arranged sequentially in the width direction of the housing 1. In this case, the gas-liquid separator 2 and the heat exchange part 4 may be adjacent to a right side wall of the housing 1. Therefore, by adopting the above arrangement, the structure of the entire switching device 100 is more compact and the space occupied by the switching device 100 is reduced, such that the application occasion and the installation position of the switching device 100 will not be affected.

According to some embodiments of the present disclosure, the plurality of first indoor-unit connection tubes 3 are arranged in a plurality of layers spaced apart in the second direction, and each layer of the first indoor-unit connection tubes 3 includes at least one first indoor-unit connection tube 3. The plurality of second indoor-unit connection tubes 5 are arranged in a plurality of layers spaced apart in the second direction, and each layer of the second indoor-unit connection tubes 5 include at least one second indoor-unit connection tube 5. The plurality of layers of first indoor-unit connection tubes 3 and the plurality of layers of second indoor-unit connection tubes 5 are spaced apart in the second direction. Thereby, the length of the switching device 100 in the first direction can be further reduced. In one embodiment, two adjacent layers of first indoor-unit connection tubes 3 are staggered in the first direction, and two adjacent layers of second indoor-unit connection tubes 5 are also staggered in the first direction. Thereby, the first indoor-unit connection tubes 3 and the second indoor-unit connection tubes 5 can be arranged more compactly in the first direction, so as to reduce the space occupied by the entire switching device 100, thereby further expanding the application occasion and the installation position of the switching device 100.

For example, in the example of FIG. 1, sixteen first indoor-unit connection tubes 3 and sixteen second indoor-unit connection tubes 5 are respectively provided, and the first indoor-unit connection tubes 3 and the second indoor-unit connection tubes 5 are respectively arranged in two layers. Each layer includes eight first indoor-unit connection tubes 3 or eight second indoor-unit connection tubes 5 evenly spaced apart in the length direction of the housing 1. Four layers of the first indoor-unit connection tubes 3 and the second indoor-unit connection tubes 5 are evenly spaced apart in the height direction of the housing 1. A group of the first indoor-unit connection tube 3 and the second indoor-unit connection tube 5 connected to the same indoor unit are aligned in the up and down direction. The two layers of the first indoor-unit connection tubes 3 are staggered along the length direction of the housing 1, and the two layers of the second indoor-unit connection tubes 5 are staggered along the length direction of the housing 1, so that the first indoor-unit connection tubes 3 and the second indoor-unit connection tubes 5 can be arranged more compactly in the length direction of the housing 1, so as to reduce the volume of the switching device 100, thereby reducing the space occupied by the switching device 100.

According to some embodiments of the present disclosure, as shown in FIGS. 1 and 2, the housing 1 includes a base 11 having an open top, and a top cover 12 detachably provided to the top of the base 11. The base 11 serves to support the entire switching device 100. The base 11 is provided with a drain tank 111. The drain tank 111 has at least one water outlet. In this case, the drain tank 111 is coupled to the base 11 for collecting the condensed water generated during the operation of the switching device 100 and discharging the collected condensed water out of the water outlet. It can be understood that the number of the water outlets and the position of the water outlet can be determined according to actual needs. Since the top cover 12 is detachably connected to the base 11, operations such as maintenance can be facilitated.

Further, the housing 1 is provided with a soundproof cotton at an inner side thereof, and the soundproof cotton may be attached to an inner surface of the housing 1. For example, the soundproof cotton may be disposed to at least one of a side wall, a top wall and a bottom wall of the housing 1. Thereby, by providing the soundproof cotton, it is possible to enclose the sound (for example, the sound of the switching of the solenoid valve unit 6) generated when the respective components in the housing 1 act during the operation of the entire switching device 100 in the entire housing 1, thereby reducing noise. Thus, the interference caused by the operation of the switching device 100 to the external environment is reduced.

In one embodiment, the housing 1 is a sheet metal member, but is not limited thereto.

Further, as shown in FIG. 1, an electric control box assembly 91 is disposed outside the housing 1. The electric control box assembly 91 is arranged vertically and disposed to a side surface of the housing 1. For example, the electric control box assembly 91 may be hung on the side surface of the housing 1, but is not limited to being fixed to any one side surface, as long as the entire electric control box assembly 91 can be fixed, such that the electric control box assembly 91 can implement the control function. The electric control box assembly 91 may be connected to an electric control component such as a solenoid valve or the like in the housing 1.

The switching device 100 for the multi-split air conditioner according to the embodiment of the present disclosure can realize separate control of cooling and heating of different indoor units. The main principle and realization method thereof are that the gas-liquid separator 2 separates the gas-liquid two-phase refrigerant such that the gaseous refrigerant flows out of the first outlet 22 and flows from the gas side to the corresponding indoor unit for heating, while the liquid refrigerant flows out of the second outlet 23 and flows from the liquid side to the corresponding indoor unit for cooling. Moreover, the separate control of different indoor units is realized by the reverse control of the corresponding solenoid valve assembly 6.

In one embodiment, as shown in FIG. 4, when a part of the plurality of indoor units operate for heating and another part of the plurality of indoor units operate for cooling, the first one-way solenoid valve 611 corresponding to the indoor unit for heating is opened (in this case, the second one-way solenoid valve 612 corresponding to the indoor unit for heating is closed) and the second one-way solenoid valve 612 corresponding to the indoor unit for cooling is opened (in this case, the first one-way solenoid valve 611 corresponding to the indoor unit for cooling is closed). The refrigerant in the outdoor unit first enters the gas-liquid separator 2 of the switching device 100 for gas-liquid separation, the separated gaseous refrigerant is discharged out of the first outlet 22, sequentially flows through the first U-shaped tube 62, the corresponding first one-way solenoid valve 611 and the first indoor-unit connection tube 3, then enters the indoor unit for heating, and the refrigerant after heat exchange returns to the outdoor unit through the second indoor-unit connection tube 5, the second check valve 72 and the second U-shaped tube 63. Moreover, the separated liquid refrigerant is discharged out of the second outlet 23, sequentially flows through the heat exchange part 4, the throttling device 9, the heat exchange part 4, the first check valve 71 and the second indoor-unit connection tube 5, then enters the indoor unit for cooling, and the refrigerant after heat exchange returns to the outdoor unit through the first indoor-unit connection tube 3, the second one-way solenoid valve 612 and the second U-shaped tube 63.

With the switching device 100 for the multi-split air conditioner according to the embodiment of the present disclosure, it is beneficial to increasing the number of indoor units that can be controlled by the outdoor unit of the entire multi-split air conditioner, reducing the splicing of multiple switching devices 100, and also, improving the efficiency of on-site installation. Meanwhile, the entire switching device 100 is hierarchical and modular, thus providing great convenience for on-site maintenance. In addition, the switching device 100 may be disposed outside the outdoor unit, thereby facilitating maintenance of the switching device 100 and various components in the outdoor unit.

A multi-split air conditioner according to embodiments of the present disclosure includes the switching device 100 for the multi-split air conditioner according to the above of embodiments of the present disclosure.

Reference throughout this specification to "an embodiment," "some embodiments," "an illustrative embodiment," "an example," "a specific example," or "some examples," means that a particular feature, structure, material, or characteristic described in connection with the embodiment or example is included in at least one embodiment or example of the present disclosure. The appearances of the above phrases in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A switching device for a multi-split air conditioner, the multi-split air conditioner comprising an outdoor unit, and a plurality of indoor units having a plurality of first ports and a plurality of second ports, wherein the switching device comprises:

a housing;

a gas-liquid separator disposed in the housing, and having an inlet, a first outlet and a second outlet, the inlet being configured to be connected to the outdoor unit;

a plurality of first indoor-unit connection tubes spaced apart in a first direction, the first outlet being connected to the plurality of first ports via the plurality of first indoor-unit connection tubes, respectively;

at least one heat exchanger having an end connected to the second outlet; and a plurality of second indoor-unit connection tubes spaced apart from the plurality of first indoor-unit connection tubes in a second direction perpendicular to the first direction, the plurality of second indoor-unit connection tubes being spaced apart in the first direction, wherein the heat exchanger has another end connected to the plurality of second ports via the plurality of second indoor-unit connection tubes respectively, part of the plurality of first indoor-unit connection tubes and the plurality of second indoor-unit connection tubes are spaced apart from the rest of the plurality of first indoor-unit connection tubes and the plurality of the second indoor-unit connection tubes in the second direction;

wherein the plurality of first indoor-unit connection tubes are arranged in a plurality of layers spaced apart in the second direction, the plurality of second indoor-unit connection tubes are arranged in a plurality of layers spaced apart in the second direction, and the plurality of layers of first indoor-unit connection tubes are spaced apart from the plurality of layers of second indoor-unit connection tubes in the second direction.

2. The switching device for the multi-split air conditioner according to claim 1, further comprising:

a solenoid valve assembly comprising a plurality of solenoid valve units arranged side by side, a first U-shaped tube and a second U-shaped tube, each solenoid valve unit comprising a first one-way solenoid valve and a second one-way solenoid valve, the first U-shaped tube being connected to the first outlet and further connected to the plurality of first indoor-unit connection tubes respectively via the plurality of first one-way solenoid valves, the plurality of first indoor-unit connection tubes being configured to be connected to the outdoor unit respectively via the plurality of second one-way solenoid valves, the first one-way solenoid valve being configured to unidirectionally guide a refrigerant in the first U-shaped tube into the corresponding first indoor-unit connection tube, the second one-way solenoid valve being configured to unidirectionally guide the refrigerant in the first indoor-unit connection tube into the outdoor unit, and one of the first U-shaped tube and the second U-shaped tube being disposed at an inner side of the other one of the first U-shaped tube and the second U-shaped tube.

3. The switching device for the multi-split air conditioner according to claim 2, wherein the heat exchanger is disposed at the inner sides of the first U-shaped tube and the second U-shaped tube.

4. The switching device for the multi-split air conditioner according to claim 2, further comprising:

a check valve assembly disposed below the solenoid valve assembly, the check valve assembly comprising a plurality of check valve units arranged side by side and extending in a horizontal direction, each check valve unit comprising a first check valve and a second check valve configured to be arranged in parallel between the heat changer and the second indoor-unit connection tube, the first check valve being configured to unidirectionally guide the refrigerant in the heat exchanger to the indoor unit, and the second check valve being configured to unidirectionally guide the refrigerant in the indoor unit to the heat exchanger.

5. The switching device for the multi-split air conditioner according to claim 4, wherein the first check valve and the second check valve are arranged one above the other.

6. The switching device for the multi-split air conditioner according to claim 4, wherein the housing has a substantially cuboid shape, the first direction is a length direction of the housing, the heat exchanger, the solenoid valve assembly and the check valve assembly are all disposed in the housing, the solenoid valve assembly is arranged above the check valve assembly, the solenoid valve assembly and the check valve assembly are disposed at one side in the length direction of the housing, while the gas-liquid separator and the heat exchanger are disposed at the other side in the length direction of the housing, and the gas-liquid separator and the heat exchanger are arranged sequentially in a width direction of the housing, an electric control box assembly is disposed outside the housing, the electric control box assembly is arranged vertically and disposed to a side surface of the housing.

7. The switching device for the multi-split air conditioner according to claim 1, wherein two adjacent layers of first indoor-unit connection tubes are staggered in the first direction, and two adjacent layers of second indoor-unit connection tubes are staggered in the first direction.

8. The switching device for the multi-split air conditioner according to claim 7, wherein the first indoor-unit connection tube is in one to one correspondence with the corresponding second indoor-unit connection tube in the second direction.

9. The switching device for the multi-split air conditioner according to claim 1, wherein the gas-liquid separator is configured to be arranged adjacent to the outdoor unit.

10. The switching device for the multi-split air conditioner according to claim 1, wherein the housing is provided with a soundproof cotton at an inner side thereof.

11. The switching device for the multi-split air conditioner according to claim 1, wherein the housing comprises a base, and the base is provided with a drain tank.

12. The switching device for the multi-split air conditioner according to claim 1, wherein the housing comprises a base having an open top and a top cover detachably disposed to the top of the base.

13. A multi-split air conditioner, comprising a switching device for a multi-split air conditioner, the multi-split air conditioner comprising an outdoor unit, and a plurality of indoor units having a plurality of first ports and a plurality of second ports, wherein the switching device comprises:

a housing;

a gas-liquid separator disposed in the housing, and having an inlet, a first outlet and a second outlet, the inlet being configured to be connected to the outdoor unit;

a plurality of first indoor-unit connection tubes spaced apart in a first direction, the first outlet being connected to the plurality of first ports via the plurality of first indoor-unit connection tubes, respectively;

at least one heat exchanger having an end connected to the second outlet; and a plurality of second indoor-unit connection tubes spaced apart from the plurality of first indoor-unit connection tubes in a second direction perpendicular to the first direction, the plurality of second indoor-unit connection tubes being spaced apart in the first direction, wherein the heat exchanger has another end connected to the plurality of second ports via the plurality of second indoor-unit connection tubes respectively, part of the plurality of first indoor-unit connection tubes and the plurality of second indoor-unit connection tubes are spaced apart from the rest of the plurality of first indoor-unit connection tubes and the plurality of the second indoor-unit connection tubes in the second direction;

wherein the plurality of first indoor-unit connection tubes are arranged in a plurality of layers spaced apart in the second direction, the plurality of second indoor-unit connection tubes are arranged in a plurality of layers spaced apart in the second direction, and the plurality of layers of first indoor-unit connection tubes are spaced apart from the plurality of layers of second indoor-unit connection tubes in the second direction.

14. The multi-split air conditioner according to claim 13, wherein the switching device further comprising:

a solenoid valve assembly comprising a plurality of solenoid valve units arranged side by side, a first U-shaped tube and a second U-shaped tube, each solenoid valve unit comprising a first one-way solenoid valve and a second one-way solenoid valve, the first U-shaped tube being connected to the first outlet and further connected to the plurality of first indoor-unit connection tubes respectively via the plurality of first one-way solenoid valves, the plurality of first indoor-unit connection tubes being configured to be connected to the outdoor unit respectively via the plurality of second one-way solenoid valves, the first one-way solenoid valve being configured to unidirectionally guide a refrigerant in the first U-shaped tube into the corresponding first indoor-unit connection tube, the second one-way solenoid valve being configured to unidirectionally guide the refrigerant in the first indoor-unit connection tube into the outdoor unit, and one of the first U-shaped tube and the second U-shaped tube being disposed at an inner side of the other one of the first U-shaped tube and the second U-shaped tube.

15. The multi-split air conditioner according to claim 14, wherein the heat exchanger is disposed at the inner sides of the first U-shaped tube and the second U-shaped tube.

16. The multi-split air conditioner according to claim 14, wherein the switching device further comprising: a check valve assembly disposed below the solenoid valve assembly, the check valve assembly comprising a plurality of check valve units arranged side by side and extending in a horizontal direction, each check valve unit comprising a first check valve and a second check valve configured to be arranged in parallel between the heat exchanger and the second indoor-unit connection tube, the first check valve being configured to unidirectionally guide the refrigerant in the heat exchanger to the indoor unit, and the second check valve being configured to unidirectionally guide the refrigerant in the indoor unit to the heat exchanger.

17. The multi-split air conditioner according to claim 16, wherein the first check valve and the second check valve are arranged one above the other.

18. The multi-split air conditioner according to claim 16, wherein the housing has a substantially cuboid shape, the first direction is a length direction of the housing, the heat exchanger, the solenoid valve assembly and the check valve assembly are all disposed in the housing, the solenoid valve assembly is arranged above the check valve assembly, the solenoid valve assembly and the check valve assembly are disposed at one side in the length direction of the housing, while the gas-liquid separator and the heat exchanger are disposed at the other side in the length direction of the housing, and the gas-liquid separator and the heat exchanger are arranged sequentially in a width direction of the housing, an electric control box assembly is disposed outside the housing, the electric control box assembly is arranged vertically and disposed to a side surface of the housing.

19. The multi-split air conditioner according to claim 13, wherein two adjacent layers of first indoor-unit connection tubes are staggered in the first direction, and two adjacent layers of second indoor-unit connection tubes are staggered in the first direction.

20. The multi-split air conditioner according to claim 19, wherein the first indoor-unit connection tube is in one to one correspondence with the corresponding second indoor-unit connection tube in the second direction.

* * * * *